US005205508A

United States Patent [19]

Masera et al.

[11] Patent Number: 5,205,508

[45] Date of Patent: Apr. 27, 1993

[54] TURRET-TYPE ROTARY ROD-FEEDER MACHINE

[75] Inventors: Ercole Masera, Roveredo In Piano; Giorgio D. Fabro, Cassacco-Fraz.Montegnacco, both of Italy

[73] Assignee: M.E.P. Macchine Elettroniche Piegatrici SpA, Reana Del Rojale, Italy

[21] Appl. No.: 667,649

[22] Filed: Mar. 11, 1991

[30] Foreign Application Priority Data

Mar. 15, 1990 [IT] Italy ..... 83347 A/90

[51] Int. Cl.[5] ..... B21C 47/18

[52] U.S. Cl. ..... 242/80

[58] Field of Search ..... 242/78, 79, 80, 64, 242/54 R

[56] References Cited

U.S. PATENT DOCUMENTS 1,629,524 5/1927 Nullmeyer ..... 242/80
2,263,889 11/1941 Rose ..... 242/79
2,575,785 11/1951 Beamon et al. ..... 242/80
2,612,324 9/1952 Yorburg ..... 242/80
3,870,244 3/1975 Sarkisov et al. ..... 242/80

FOREIGN PATENT DOCUMENTS 2182594 12/1973 France .

*Primary Examiner*—John M. Jillions
*Attorney, Agent, or Firm*—Antonelli, Terry, Stout & Kraus

[57] ABSTRACT

Turret-type rotary rod-feeder machine located upstream of a user machine such as a straightener machine, shears and/or bending and shaping machine, the rod-feeder machine being suitable to bear rolls of rod made with a hot or cold process for reinforced concrete and comprising a rotary support (22), which has a substantially vertical axis of rotation (17) and bears along a circumference at least two reels (11) holding rolls (15) of rod and having their axis of rotation substantially parallel to the axis of rotation (17) of the rotary support (22), each reel (11) cooperating with a specific stand (13) that engages and guides the rod.

7 Claims, 2 Drawing Sheets

TURRET-TYPE ROTARY ROD-FEEDER MACHINE

This invention concerns a turret-type rotary rod-feeder machine. To be more exact, the invention concerns a rotary machine to feed rolls of rod for reinforced concrete to machines which process such rod, such as straightening and shearing machines and/or automatic stirrup- forming and bending machines, the rotary machine being capable of being positioned in direct relation to the working programme of the processing machines.

Technical development in the field of rolling steels with an improved adherence for reinforced concrete has undergone a great change in recent years. The main reasons leading to this change are:

fierce competition between producers;

the need to save energy;

the need to optimize all resources as much as possible and therefore to reduce rejects of all processes to a minimum, the need to increase output considerably and therefore to tend to use automatic cycles with ever higher speeds of production, and the need to offer a product the mechanical and physical properties of which can be guaranteed.

This change has led to the production of rod for reinforced concrete in rolls instead of in sections, with a progressive increase of the diameter which can be produced in rolls.

Until a few years ago rod in rolls was used with a maximum diameter of 12 mm.; experiments are now in progress for the use of rod having diameters of 18 and 20 mm.

The reason for this evolution has arisen substantially from the following factors:

the maximum rolling speed for rods in sections is about 35/40 meters per second, whereas the rolling speed for rods in rolls is already higher then 100 meters per second;

the higher rolling speed enables billets to be used which have a weight of more than 2000 kgs., with a resulting reduction of the percentage of scrap owing to the shearing of the leading and trailing ends;

use of rolls eliminates the need to have to hold stocks of rods in sections of different commercial lengths (for instance, 12 mts., 14 mts., 18 mts., 24 mts.) with a consequent reduction of the money tied up.

However, these advantageous factors entail limits of usage as follows.

If we assume the weight of a roll of rod to be constant at 2000 kgs. for instance, the user's advantage decreases with an increase in the diameter of the rod. In fact, a roll of 2000 kgs. will contain:

9,049 mts. of rolled rod with a diameter of 6 mm.
5,075 mts. of rolled rod with a diameter of 8 mm.
3,246 mts. of rolled rod with a diameter of 10 mm.
2,254 mts. of rolled rod with a diameter of 12 mm.
1,657 mts. of rolled rod with a diameter of 14 mm.
1,268 mts. of rolled rod with a diameter of 16 mm.
1,002 mts. of rolled rod with a diameter of 18 mm.
811 mts. of rolled rod with a diameter of 20 mm.

The machines which employ reinforcement rod in rolls, particularly the straightening and shearing machines and the automatic stirrup- forming machines have had and are now having a considerable evolution and are offering ever greater speeds of output.

With a working speed of 2 meters per second of these user machines the replacement of an exhausted roll is carried out as follows:

| ϕ of steel | Meters per 2000 kgs. | Feed time |
|---|---|---|
| 6 mm. | 9,049 mts/roll | 1 hr 19 min. |
| 10 mm. | 3,246 mts/roll | 27 min. |
| 16 mm. | 1,268 mts/roll | 10 min. |

As the time for changing a roll is not productive irrespective of the weight of the roll and the diameter of the roll, it can be readily understood that the yield of processing with a rod diameter of 16 mm. is reduced to values between 60% and 70%.

Next, when we consider that there are other factors which have an unfavourable effect on output, it is easy to see that the yield with the large diameters drops to 50% or less.

To prevent this loss of output which tends to cancel out the advantages described above and due to the employment of a product packaged in rolls rather than in sections of rod, and also to reduce the downtimes caused by a change in the processing size and to be able to work near the roll being processed without any danger, the present applicant has designed, tested and embodied a turret-type rotary rod-feeder machine to change and/or replace rolls being processed.

According to the invention a support is provided which can rotate about a substantially vertical axis. This support holds at least two reels which have their axes substantially parallel to the axis of the rotary support and are positioned along a circumference having as its generating centre the axis of rotation of the rotary support.

The reels may be of a powered type or an idler type which can be halted by a brake.

A stand to engage and guide the rod is included in cooperation with each reel fitted to the support; these engagement and guide stands are positioned radially to the axis of rotation of the rotary support.

The rotary support is enabled to rotate in coordination with the position of the engagement and guide stands in relation to the downstream usage means, whether this latter be a straightening machine or another means.

As regards height, the engagement and guide stand is positioned at about the height of entry of the rod into the downstream usage machine.

The engagement and guide stand is positioned in direct correlation with the downstream usage machine in relation to the selected roll of rod.

When the rod being processed has to be changed, for instance owing to a change of size, it is wound back and left protruding slightly from the engagement and guide stand. Then the rotary support of the reels is rotated so as to position correctly the engagement and guide stand cooperating with the roll of rod of the new size.

The whole machine is located advantageously in a pit when the rolls of rod are of a hot rolled type and therefore are more than 1500 mm. high.

The need for a pit or for means suitable to position the roll at different heights arises from the fact that according to the invention the unwinding of the rod from the roll has to take place in such a way that there is always a feeding force having an upward component.

If instead the roll is of a compact type, as is the case with cold rolled material made by conversion of rod, the turret-type rotary rod-feeder machine can be installed without a pit since the departure of the rod from the engagement and guide stand takes place at a height suitable for the downstream usage means and generates the required upward component at the same time.

In fact, the height of the compact rolls is never greater than 1000 mm. and therefore the need to raise the rod to bring it to the height required by the downstream usage means generates in any case the effect of raising the rod from the roll.

According to the invention, between one roll and another on the rotary feeder machine there is included a protective shield suitable to enable the rolls to be replaced and the end of the rod to be positioned even where there is a roll being processed. These protective shields may be stationary or be capable of being opened and will rotate together with the rotary support.

Moreover, according to the invention a gangway is provided between the reels to facilitate the operations of changing and installing the rolls.

According to a variant the rotation of the rotary feeder machine is actuated automatically.

According to a further variant of the invention the actuation is linked to an automatic programme that governs the work of the downstream usage means.

The attached figures, which are given as a non-restrictive example, show the following:

Figure 1:
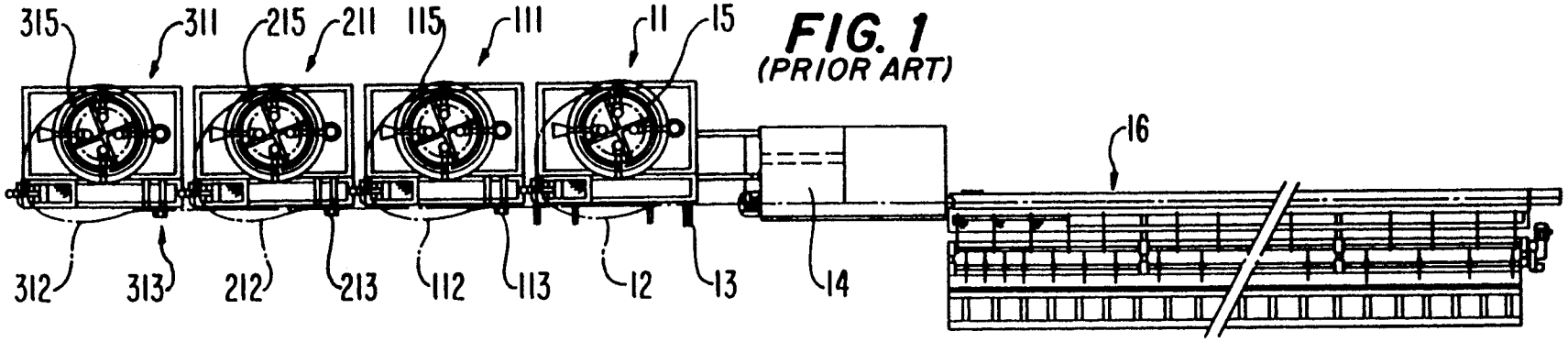
FIG. 1 (PRIOR ART)
FIG. 1 shows the present state of the art.

Rolls 15-115-215-315 of rod are positioned at present (FIG. 1) in a group on their respective individual reels 11-111-211-311 and the relative rods 12-112-212-312 are placed on their respective engagement and guide stands 13-113-213-313.

The roll 15 being processed has its rod 12 on its engagement and guide stand 13 before feeding the rod 12 to a downstream usage means 14 and thence in the form of shaped or straightened rods to a storage bench 16.

When it is necessary to process the rod 212 in the roll 215 on the reel 211, for instance, and therefore to change the diameter, the rod 12 is secured to its stand 13, and the rod 212 is then engaged and fed to the usage means 14. The whole plant is halted while the size of rod is being changed.

The changing of the roll being processed may be caused by the need to change the size of the rod or by the need to replace the exhausted roll.

In any event the time required to reposition the rod in the downstream usage means is considerable in both cases.

Furthermore, where a roll is finished in the state of the art, it is not possible to position a new roll, above all a roll next to that being processed or a roll between that being processed and the downstream usage means 14, while that other roll is being processed since this is an extremely dangerous operation.

Figure 2:
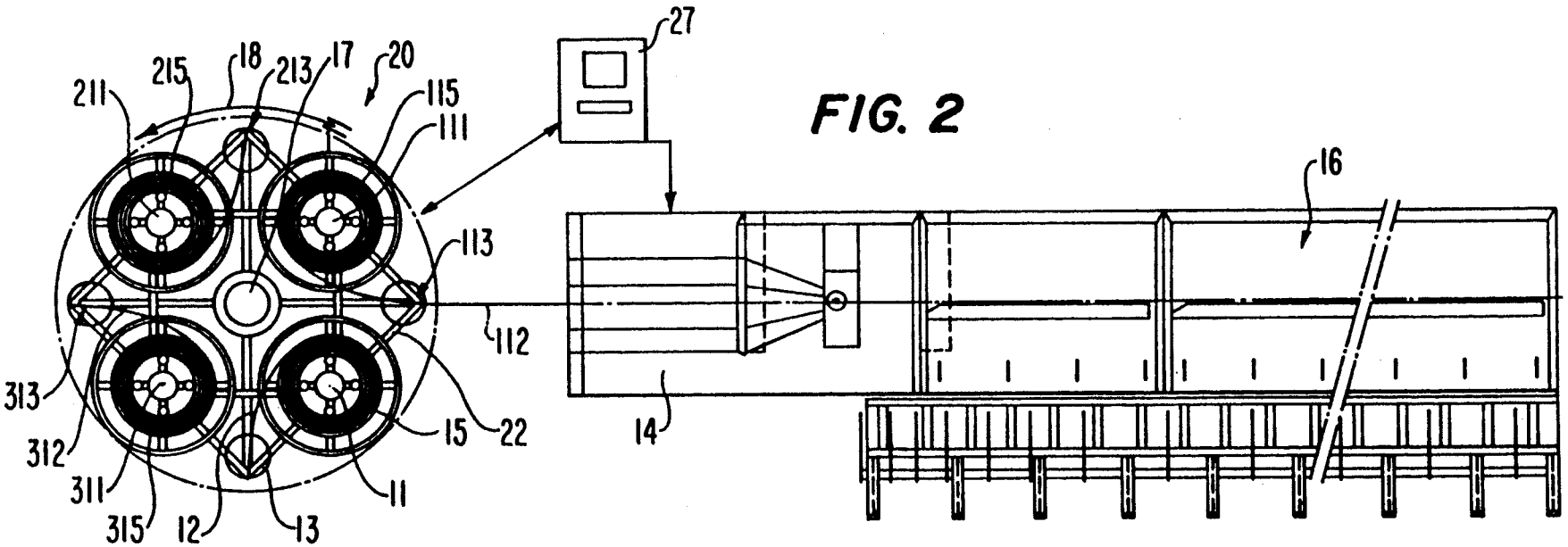
FIG. 2 shows the proposed technology.

The embodiment of FIG. 2 remove these shortcomings, for in this embodiment a turret-type rotary feeder machine 20 comprises two or more reels 11 (four in this example), and a rotary support 22 rotates in a controlled manner about its axis 17 on wheels 24.

According to the invention the reels 11 cooperate with relative stands 13, which engage and guide the rods 12 and are located on an outer position and which induce in the rod 12 an upward component 25 that assists detachment of the rod 12 from the roll 11.

In this case the axis of rotation 17 of the support 22 lies substantially on a vertical plane passing through the line of work of the downstream usage means 14.

In this situation, if we envisage rotation of the rotary support 22 in an anticlockwise direction 18, the roll which can be set to work immediately after the roll 115 is the roll 15, but the rolls 315 and 215 can also be set to work if so required.

Figure 4:
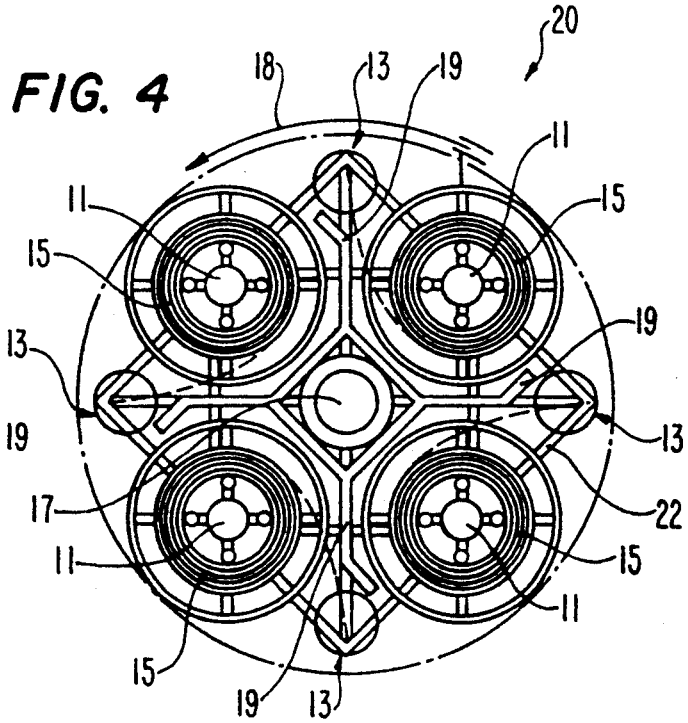
FIG. 4 is a view from above of the machine of FIG. 3.

In the example of FIG. 4 the rolls are protected by a metallic shield 19 consisting of segments, while the rotary feeder machine 20 is protected by screens 26 which include inlet doors.

The segments of the metallic shield 19 may be able to slide along each other horizontally and vertically so as to provide a total closure when the roll in question is being processed or to provide a required opening of the shield if the roll has to be tended.

As we said above, the rotary feeder machine 20 will include along its periphery a screen 26 with access doors.

Figure 3:
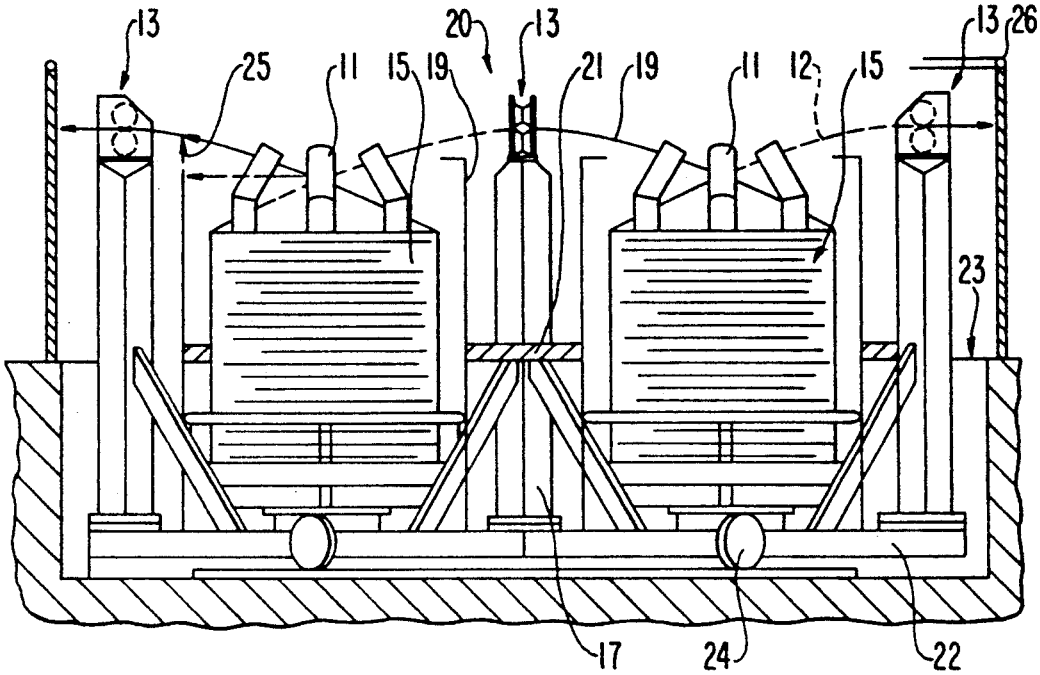
FIG. 3 shows a side view of a rotary feeder machine according to the invention.

The fact that the roll 15 being processed is protected by a shield 19 enables the machine operator to work on the other rolls or reels in complete safety by moving along a gangway 21, as shown in the example of FIG. 3.

According to the invention a safety device is provided to prevent rotation of the rotary support 22 when any of the access doors are open or when the shield 19 of the roll being processed is open.

A pit 23, if provided, may be square or circular and may include or not a gangway 21 around the reels 11.

The reels 11 being processed may include a brake device synchronized with the downstream usage machine and possibly also a start-up and/or powered device to assist the unwinding of the roll at high speeds of feed of the rod.

The drive of the reels 11 may also be capable of an inverted movement and therefore may be employed to wind back the rod remaining in the downstream usage machines when the size of rod is changed.

Inversion of the movement may be actuated automatically or by hand in such a way that the rod will remain protruding from the engagement and guide stand 13 by the length necessary for it to be re-engaged later by a device able to insert it into the usage machine or by the machine operator for manual insertion.

It is also possible to provide coordination between the downstream usage machine and the rotary feeder machine 20 by using a computer 27 that processes the data of customer orders already stored in the computer so as to optimize and reduce to a minimum the number of rotations of the rotary feeder machine 20 during a given period of time.

We claim:

1. Turret-type rotary rod-feeder machine located upstream of a user machine such as a straightener machine, shears and/or bending and shaping machine, the rod-feeder machine being suitable to bear rolls of rod made with a hot or cold process for reinforced concrete and being characterized in that it comprises a rotary support, which has a substantially vertical axis of rotation and bears along a circumference at least two reels holding rolls of rod and having their axes of rotation substantially parallel to the axis of rotation of the rotary support, each reel cooperating with a specific rod engagement and guide stand that engages and guides the rod, wherein the rod engagement and guide stand is installed on the rotary support beside and outside a circumference of the specific reel and is higher than the roll of rod and exerts on the rod being unwound an upward drawing action.

2. Turret-type rotary rod-feeder machine as claimed in claim 1, which comprises a protective shield (19) at least for a roll being unwound.

3. Turret-type rotary rod-feeder machine as claimed in claim 1, in which a gangway is included between the reels.

4. Turret-type rotary rod-feeder machine as claimed in claim 1, in which the axis of rotation of the rotary support lies substantially on a vertical plane containing the working line of a downstream usage machine.

5. Turret-type rotary rod-feeder machine as claimed in claim 4, in which the vertical plane containing the axis of rotation of the rotary support is a diametrical plane and contains also the axis of the passage of the rod through the rod engagement and guide stand.

6. Turret-type rotary rod-feeder machine as claimed in claim 1, in which the rotation of the rotary feeder machine is servo-assisted and remote-controlled.

7. Turret-type rotary rod-feeder machine as claimed in claim 6, in which the rotation of the rotary feeder machine is controlled and conditioned by a computer which also governs the downstream usage machine.

* * * * *